US008544522B2

(12) United States Patent
Lin

(10) Patent No.: US 8,544,522 B2
(45) Date of Patent: Oct. 1, 2013

(54) WINDOW COVERING

(75) Inventor: Tzong-Fu Lin, Taipei (TW)

(73) Assignee: Whole Space Industries Ltd, Taipei (TW)

( * ) Notice: Subject to any disclaimer, the term of this patent is extended or adjusted under 35 U.S.C. 154(b) by 75 days.

(21) Appl. No.: 13/273,375

(22) Filed: Oct. 14, 2011

(65) Prior Publication Data

US 2012/0160426 A1 Jun. 28, 2012

Related U.S. Application Data

(60) Provisional application No. 61/427,342, filed on Dec. 27, 2010.

(51) Int. Cl.
*A47H 5/00* (2006.01)

(52) U.S. Cl.
USPC ..... 160/84.01; 160/84.04; 160/178.3

(58) Field of Classification Search
USPC ..... 160/178.3, 168.1 R, 84.01, 84.04, 160/173 R, 178.1
See application file for complete search history.

(56) References Cited

U.S. PATENT DOCUMENTS

| | | | | |
|---|---|---|---|---|
| 1,321,800 | A | 11/1919 | Andress et al. | |
| 2,586,340 | A | 2/1952 | Hyde | |
| 2,678,094 | A | 5/1954 | Sargent | |
| 4,096,904 | A | 6/1978 | Donofrio | |
| 4,681,279 | A | 7/1987 | Nakamura | |
| 4,880,044 | A * | 11/1989 | Judkins | 160/84.04 |
| 4,909,298 | A | 3/1990 | Langhart et al. | |
| 5,482,105 | A | 1/1996 | Rude | |
| 5,485,874 | A * | 1/1996 | Whitmore | 160/115 |
| 5,533,559 | A | 7/1996 | Judkins | |
| 5,566,735 | A | 10/1996 | Jelic | |
| 5,613,540 | A * | 3/1997 | Jelic | 160/84.04 |
| 5,630,458 | A | 5/1997 | Holden | |
| 5,743,319 | A * | 4/1998 | Christopherson | 160/173 R |
| 5,787,951 | A | 8/1998 | Tonomura et al. | |
| 5,918,657 | A * | 7/1999 | Tuzmen | 160/168.1 R |
| 6,431,248 | B1 | 8/2002 | Hyman et al. | |
| 6,484,787 | B1 | 11/2002 | Walters | |
| D468,950 | S | 1/2003 | Judkins | |
| D473,743 | S | 4/2003 | Judkins | |
| 6,637,493 | B1 | 10/2003 | Lampers | |
| 6,662,845 | B1 | 12/2003 | Palmer | |
| 6,817,399 | B2 | 11/2004 | Berman et al. | |
| 6,860,312 | B2 | 3/2005 | Judkins | |
| 6,880,608 | B2 * | 4/2005 | Robinson | 160/178.3 |
| 6,918,425 | B2 | 7/2005 | Nien | |
| 6,948,546 | B2 | 9/2005 | Nien | |

(Continued)

OTHER PUBLICATIONS

U.S. Appl. No. 12/755,477, filed Apr. 7, 2010.

(Continued)

*Primary Examiner* — Blair M. Johnson
(74) *Attorney, Agent, or Firm* — Buchanan Ingersoll & Rooney PC

(57) ABSTRACT

A window covering includes window covering material that extends from a first rail. A first lift cord extends from the first rail to a position adjacent the bottom of the window covering material. A first spacer cord extends from the first rail to a position adjacent to a bottom of the window covering material. First hitches extend from the first spacer cord to encircle the first lift cord. The window covering may have additional lift cords and may utilize other similar spacer cords having hitches that extend to those lift cords as well.

20 Claims, 9 Drawing Sheets

(56) References Cited

U.S. PATENT DOCUMENTS

| | | | | |
|---|---|---|---|---|
| 6,988,526 | B2 | 1/2006 | Judkins | |
| 7,000,672 | B2 | 2/2006 | Nien | |
| 7,086,446 | B2 | 8/2006 | Kollman et al. | |
| 7,117,918 | B2 | 10/2006 | Franssen | |
| 7,225,850 | B2 | 6/2007 | McCarty et al. | |
| 7,261,138 | B2 | 8/2007 | Judkins et al. | |
| 7,318,251 | B2 | 1/2008 | Lin | |
| 7,556,080 | B2 * | 7/2009 | Nien | 160/168.1 R |
| 7,624,784 | B2 | 12/2009 | Anthony et al. | |
| 8,316,911 | B2 * | 11/2012 | Cleaver | 160/84.01 |
| D672,179 | S * | 12/2012 | Lin | D6/575 |
| 8,365,795 | B2 * | 2/2013 | Perkowitz | 160/84.01 |
| 2006/0060308 | A1 | 3/2006 | LeBlanc et al. | |
| 2006/0144526 | A1 | 7/2006 | McGinley | |
| 2006/0157204 | A1 | 7/2006 | Lin | |
| 2007/0023149 | A1 | 2/2007 | Lamars et al. | |
| 2007/0175593 | A1 | 8/2007 | Lin | |
| 2008/0110581 | A1 | 5/2008 | Lin | |
| 2008/0277074 | A1 | 11/2008 | Lin | |
| 2008/0295975 | A1 | 12/2008 | Lin | |
| 2011/0186242 | A1 | 8/2011 | Foley et al. | |
| 2011/0203079 | A1 * | 8/2011 | Anthony et al. | 24/115 F |
| 2012/0160426 | A1 * | 6/2012 | Lin | 160/84.04 |
| 2012/0168094 | A1 * | 7/2012 | Lin | 160/84.04 |

OTHER PUBLICATIONS

U.S. Appl. No. 12/770,881, filed Apr. 30, 2010.

U.S. Appl. No. 12/780,245, filed May 14, 2010.

WCMA Window Covering Manufacturers Association, 2nd Provisional American National Standard for Safety of Corded Window Covering Products; Sponsor Window Covering Manufacturers Association, Inc.

* cited by examiner

WINDOW COVERING

CROSS REFERENCE TO RELATED APPLICATION

The present application claims priority to U.S. Provisional Patent Application No. 61/427,342, which was filed on Dec. 27, 2010.

FIELD OF INVENTION

The present invention relates to window coverings, such as Roman shades or other types of shades.

BACKGROUND OF THE INVENTION

One popular type of window covering is known as a Roman shade which may also be called a Roman blind, an Austrian shade, a Balloon Shade, or a Soft Shade. This type of shade consists of a panel or sheet of material attached along its top edge to a headrail and gathered at spaced intervals to provide a series of soft transverse folds across the face of the fabric. Consequently, the typical Roman shade has a cascaded or softly pleated appearance. Such Roman shades are usually constructed so that when they are raised from an extended position, they gather from the bottom in generally horizontal folds or pleats until the entire shade resides near the top of the window covering in a retracted position. Often, ballast members such as metal rods or metal bars are positioned within pockets formed in the shade material to provide weight to the shade to form the soft transverse folds. The Roman shades are often operated by pulling on lift cords which pass through rings or similar guides attached to the shade.

In other versions of Roman shades, such as a Roman shade product sold under the AudraGuard name, the shades are operated by pulling on a beaded looped cord of a loop cord drive. Actuation of the loop cord drive causes a shaft or roller to rotate to wind or unwind a plurality of lifting tapes that pass through metal clips or loops attached to the rear face of the shade material and have a terminal end attached to a bottom portion of the shade material. The winding of the lifting tapes causes the shade material to be raised, or retracted. The unwinding of the lifting tapes causes the shade material to lower, or extend.

Most prior art Roman shades have window covering material that is formed either of a sheet of a flexible material such as a fabric or film, a plurality of segments of material connected together, or woven wood. The material or interconnected segments are typically provided with a plurality of horizontal folds at points vertically spaced from one another to form folds when the shade is raised. A common method for making a Roman shade is to sew or attach at least two sets of rings or connectors along vertical lines down the back of the fabric material as is shown in U.S. Pat. No. 1,321,800. The spacing of the rings or connectors affects the aesthetic effect of the shade and how the window covering material may look when being raised or lowered. Lift cords pass through the rings and each lift cord is attached to a bottom rail or the lowermost fold. Opposite ends of the lift cords are wound on a spool or shaft in the headrail. The spool or shaft may be turned by a cord loop device or a spring motor to raise and lower the shade. Alternatively, the lift cords may pass through a cord lock and be moved by a user to turn the spool or shaft.

The shade may also include spacer cords that pass through the rings. The spacer cords are typically attached to the headrail of the shade and the rings and are configured to help improve the aesthetic effect of the shade when the window covering material is raised or lowered. A liner may also be included in such shades. Additionally, Roman shades may be configured as a top down bottom up shade. Roman shades may also have other configurations, such as the configurations disclosed in U.S. Pat. Nos. D473,743, D468,950, and 7,624,784, 6,988,526, 6,662,845, and 5,787,951 and U.S. Patent Application Publication Nos. 2011/0186242, 2008/0295975, 2008/0277074, 2007/0175593, 2006/0060308 and 2006/0157204.

On occasion, children have been able to get behind a lowered Roman shade, pull a lift cord to form a loop and become entangled in the loop. If the lift cord is around the child's neck and the child falls, the cord could act as a noose and strangle the child. Indeed, reports of such incidents have prompted at least one major retailer to issue a recall of one product line of Roman shades and the United States Consumer Product Safety Commission (CPSC) has issued a warning about the danger of child entanglement and hanging from the cords in Roman shades. In addition the CPSC has issued guidelines, rules and proposed rules that require window covering manufacturers to make shades with inaccessible cords or to construct the window covering product in a manner so that a child cannot form a loop in the lift cord which is large enough, greater than 8 inches in diameter, for a child's head to fit through the loop.

There have also been incidents of child entanglements in lift cords of venetian blinds and other types of window coverings. As a result, the art has developed various types of child safety devices that are intended to prevent deaths of children who become entangled in lift cords. For instance, U.S. Pat. Nos. 7,318,251, 7,261,138, 7,225,850, 7,117,918, 7,086,446, 7,000,672, 6,948,546, 6,918,425, 6,860,312, 6,637,493, 6,484,787, 6,431,248, 5,630,458, 5,533,559 and 4,909,298 and U.S. Patent Application Publication Nos. 2008/0110581, 2007/0023149 and 2006/0144526 disclose child safety devices for blinds. Child safety devices may be configured to keep the lift cords taught so that the cords cannot be pulled away from the window covering material and form a noose or release the cord from the shade when a child becomes entangled in the shade. Most, if not all of the cord release devices are not well suited for use on Roman shades. Moreover, many conventional child safety devices for window coverings are visible from the front of the shade and detract from the aesthetic effect of the shade.

A new window covering is needed to replace or change a conventional Roman shade design to help prevent the entanglement of children within exposed cords. Preferably, the window covering design could also be configured for use in other shade designs having exposed lift cords, such as pleated shades.

SUMMARY OF THE INVENTION

A window covering may include window covering material that extends from a first rail. The window covering material is moveable from a retracted position to an extended position. A plurality of rings is attached to the window covering material. The rings include a first column of vertically aligned rings and a second column of vertically aligned rings. A first lift cord extends from the first rail and through the first column of vertically aligned rings. A second lift cord extends from the first rail and through the second column of vertically aligned rings. A first spacer cord extends from the first rail to a position adjacent to a bottom of the window covering material. The first spacer cord is comprised of a plurality first loops that extend from the first spacer cord such that each loop encircles a respective ring in the first column of vertically spaced rings and a plurality of first hitches that extend from the first spacer cord to encircle the first lift cord. The first lift cord passes through the first hitches as well as the rings. A second spacer cord is also provided. The second spacer cord extends from the first rail to a position adjacent to a bottom of the window covering material. The second spacer cord is comprised of a plurality first loops that extend from the second spacer cord such that each loop encircles a respective one of the rings in the second column of vertically spaced rings and a plurality of second hitches that extend from the second spacer cord to encircle the second lift cord. The second lift cord passes through the second hitches as well as the rings of the second column of rings. A similar arrangement of spacer cords and rings may be used for additional lift cords used on window shade.

The hitches may be configured to loosely receive the respective portions of the lift cords such that each hitch encircles a lift cord. A hitch may also be used to attach the spacer cord to a ring of a column of rings. In all embodiments the spacer cord limits the distance that small children are able to move the lift cords away from the window covering material. For example, the hitches are configured to grip the lift cord the hitch may encircle when the lift cord is moved horizontally away from the space cord from which the hitch extends to prevent the lift cord from moving away from at least one of the spacer cord and the window covering material. Consequently, the lift cords are unable to form a loop that could pose a strangulation threat to the child.

Some embodiments of the window covering may be configured as top down bottom up shades, pleated shades, Roman shades, or other types of shades or blinds that may have exposed lift cords.

Embodiments of the window covering may include a cord lock positioned in the first rail. Alternatively, the lift cords could be connected to spools or a rotating shaft positioned in the first rail. An actuation mechanism or lift cord control mechanism could be connected to the spools or rotating shaft. For instance, the lift cord control mechanism could be a spring motor, a spring motor unit, a loop cord drive, a motor, a remote controlled motor, or other lift cord control mechanism.

In some embodiments, the first rail may be a headrail and the window covering may include a bottom rail connected to the bottom edge of the window covering material or a terminal end of each lift cord. A liner could also be connected to the first rail and the window covering material to help cover the lift cords and spacer cords.

A window covering is also provided that may include window covering material that extends from a first rail. The window covering material is moveable from a retracted position to an extended position. A plurality of rings is attached to the window covering material. The rings include a first column of vertically aligned rings and a second column of vertically aligned rings. A first lift cord extends from the first rail and through the first column of vertically aligned rings. A second lift cord extends from the first rail and through the second column of vertically aligned rings. A first spacer cord extends from the first rail to a position adjacent to a bottom of the window covering material. The first spacer cord is comprised of a plurality of first hitches that extend from the first spacer cord to encircle the first lift cord. Some of the first hitches also encircle the rings of the first column of rings. The first lift cord passes through the first hitches that encircle the first lift cord as well as the rings. A second spacer cord is also provided that extends from the first rail to a position adjacent to a bottom of the window covering material. The second spacer cord is comprised of a plurality of second hitches that extend from the second spacer cord to encircle the second lift cord or a respective one of the rings of the second column of rings The second lift cord passes through the second hitches that encircle that lift cord as well as the rings of the second column of rings. A similar arrangement of spacer cords and rings may be used for additional lift cords used on window shade.

Yet another embodiment of a window covering is provided that may include window covering material that extends from a first rail. The window covering material is moveable from a retracted position to an extended position. A first lift cord extends from the first rail and a second lift cord extends from the first rail. A first spacer cord extends from the first rail to a position adjacent to a bottom of the window covering material. A plurality of first hitches extend from the first spacer cord to encircle the first lift cord. Some of the first hitches also encircle the rings of the first column of rings. The first lift cord passes through the first hitches that encircle the first lift cord as well as the rings. A second spacer cord is also provided that extends from the first rail to a position adjacent to a bottom of the window covering material. A plurality of second hitches extend from the second spacer cord to encircle the second lift cord or a respective one of the rings of the second column of rings The second lift cord passes through the second hitches that encircle that lift cord as well as the rings of the second column of rings. A similar arrangement of spacer cords may be used for additional lift cords used on window shade.

Other details, objects, and advantages of the invention will become apparent as the following description of certain present preferred embodiments thereof and certain present preferred methods of practicing the same proceeds.

BRIEF DESCRIPTION OF THE DRAWINGS

Present preferred embodiments of my window covering are shown in the accompanying drawings and certain present preferred methods of practicing the same are also illustrated therein.

DESCRIPTION OF PRESENT PREFERRED EMBODIMENTS

Figure 1:
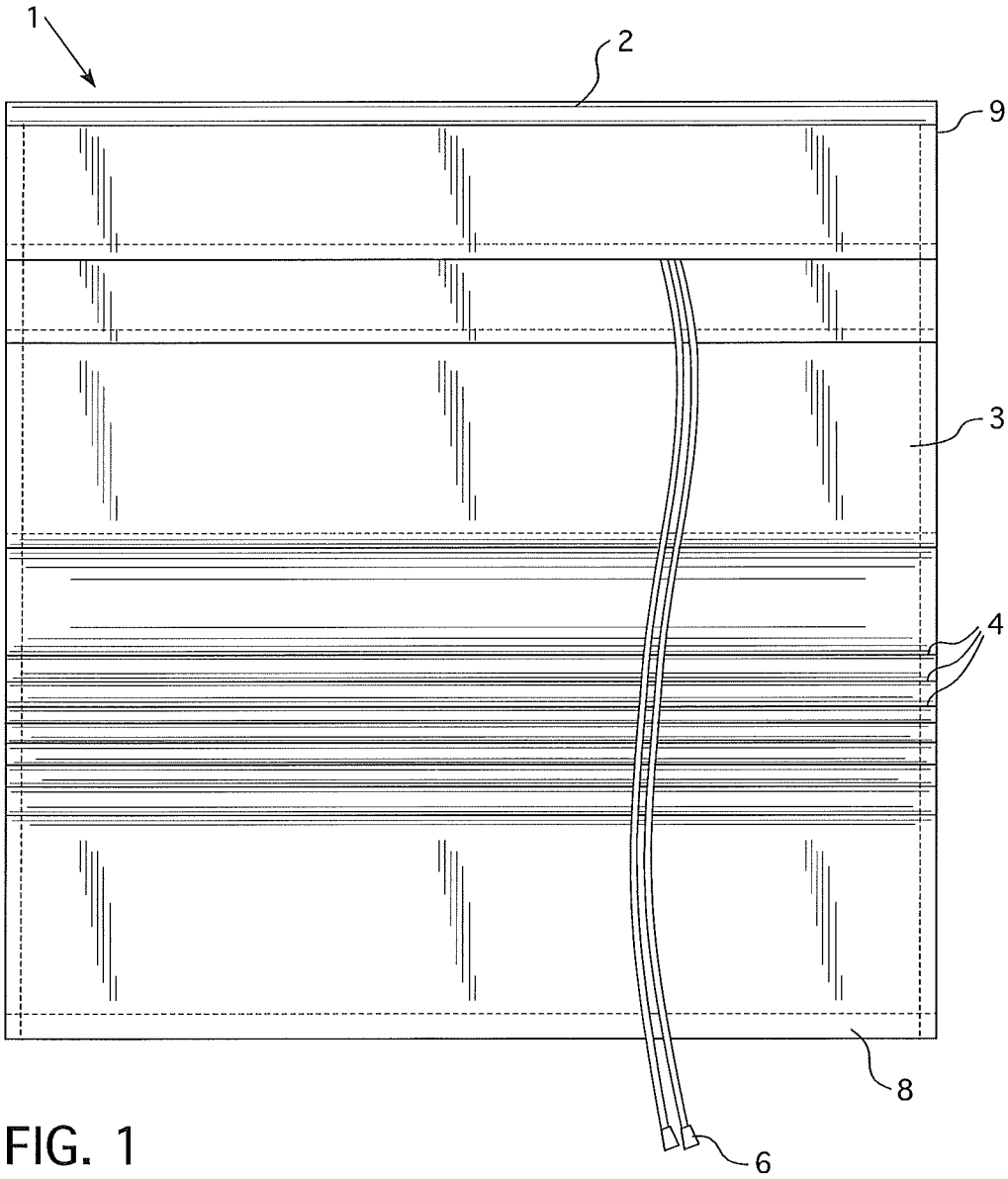
FIG. 1 is a front view of a first present preferred embodiment of the window covering in a partially retracted, or partially raised, position.

Referring to FIGS. 1-8, a window covering 1 includes window covering material 3 that is attached to a headrail 2. A valance 9 may also be attached to the headrail 2. The window covering material and the valance 9 may each be composed of any of a number of different types of material such as woven fabric, non-woven fabric, pleated material, cellular material, interconnected fabric segments, woven wood, woven grass, woven bamboo, film, or other material. The window covering material may be moveable from a retracted position, or raised position, to an extended position, or lowered position.

A lift cord control mechanism may be attached to the headrail. The lift cord control mechanism may include a cord lock 5 through which lift cords 6 pass. An operator may manipulate the cords that extend from the cord lock and out near the front of the window covering 1 to raise or lower the window covering material. It should be understood that the lift cords may be cords, strips of material, lifting tape or other flexible elongated members that extend through the cord lock to the window covering material for purposes of raising and lowering the window covering material.

In alternative embodiments, the lift cord control mechanism may include a rotatable shaft. The lift cords may be wound and unwound from the shaft via rotation of the shaft. The lift cords could be directly wound and unwound from the shaft or may be wound and unwound from pulleys attached to the shaft. The shaft may be rotated by a loop cord drive connected to the shaft. A user could then manipulate the loop cord of the loop cord drive to adjust the position of the window covering. Alternatively, the shaft could be rotated by a motor unit or a spring motor unit.

As yet another alternative embodiment, the window covering could include a lift cord control mechanism that includes a spring motor or one or more spring motor units. The position of the window covering could then be adjusted by a user pulling the window covering material down or pushing the window covering material slightly upwards to actuate the one or more spring motors.

Rings 12 or loops may be attached to the rear side of the window covering material. The rings 12 may define a plurality of vertically aligned columns of spaced apart rings. Each column may be positioned for receiving a respective one or more lift cords 6 that extend from the headrail 2. Each lift cord may pass through the headrail 2 or be connected to a spool in the headrail. The other terminal end of each lift cord 6 may be attached to the window covering material adjacent to a bottom portion 8 of the window covering material 3. For instance, a terminal end of each lift cord 6 may be attached to a respective bottom ring 12*b* on the window covering material. In alternative embodiments, a terminal end of each lift cord 6 may be attached to a bottom rail 18 attached to the window covering material 3.

The window covering material may be configured as a Roman shade by being configured to form generally transverse or horizontal folds 4 in the front side of the window covering material when the window covering material is raised. The formation of the folds may be created via connections formed between rings 12 attached to the window covering material and lift cord 6 that extend through those rings 12. Weighted rods, bars, or other members (not shown) may also be positioned in the window covering material 3 to help form the folds 4 when the window covering material is raised.

Figure 10:
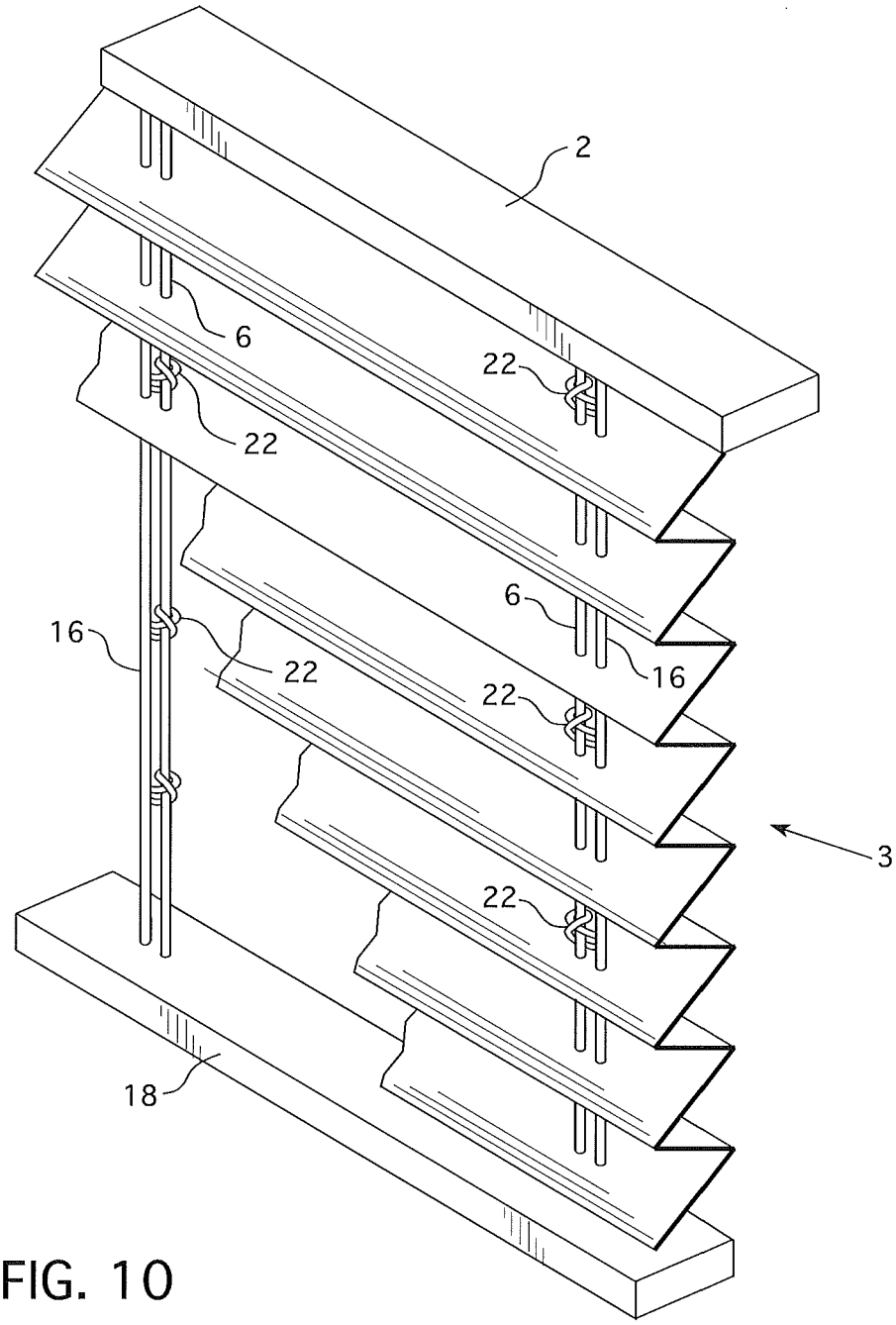
FIG. 10 is a rear perspective view of an embodiment of the window covering configured as a pleated shade. Portions of the pleated material of the window covering are cut away to better illustrate a lift cord and spacer cord that may be used in embodiments of the shade.

As may be seen from FIG. 10 the window covering material may be pleated and the window covering may be configured as a pleated shade in alternative embodiments. In yet other alternative embodiments, the sheet of material may be configured for raising and lowering similar to other types of shades or blinds.

Spacer cords 16 extend from the headrail 2 to a position adjacent to the lowermost ring 12*b* or bottom rail 18 of the window covering material. Each spacer cord may pass adjacent to a column of rings but does not pass through the rings. In alternative embodiments, each spacer cord may pass through the openings of the adjacent column of rings.

Each spacer cord 16 has loops 21 or eyelets that extend from the spacer cord 16 and encircle portions of a lift cord 6. In the embodiments shown in the FIGS. 1 through 8 some of these loops form a hitch 22 encircling a lift cord. Additionally, loops 21*a* extend from the spacer cord adjacent to and are attached to the ring. The attachment of the spacer cord to the successive rings 12 as well as the lift cord and the spacing of the rings prevent the lift cord from being pulled sufficiently far from the window covering material to form a loop that is large enough to be a strangulation hazard to a child. Preferably, the spacing between immediately adjacent rings of a vertical column of rings is between four and eight inches or ten and twenty centimeters.

Figure 9:
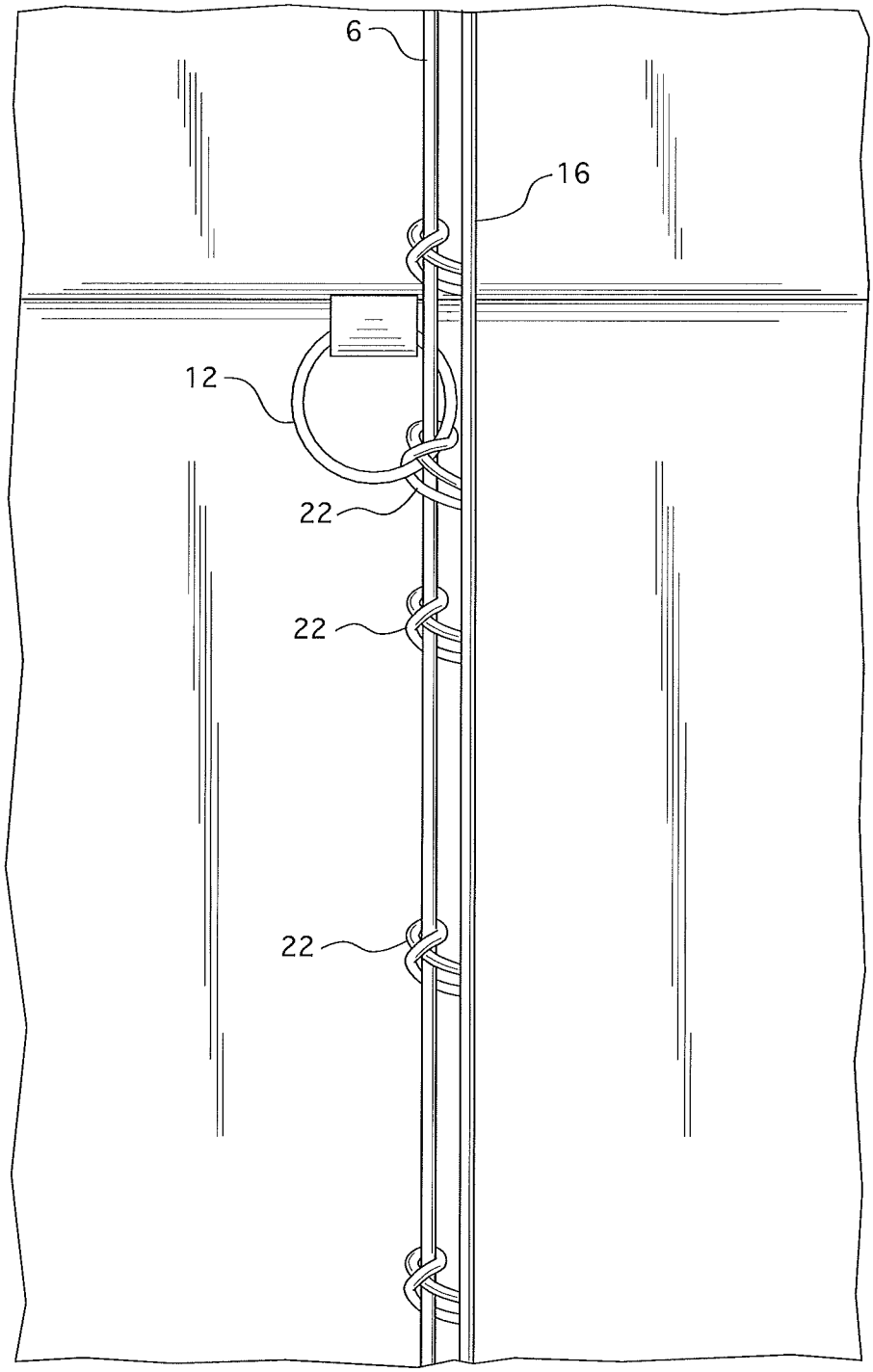
FIG. 9 is an enlarged fragmentary view similar to FIG. 8 of a portion of a second present preferred embodiment of the window covering that utilizes hitches extending from spacer cords to lift cords and rings.

In alternative embodiments, the loops 21*a* may be replaced with hitches 22 such that hitches 22 also extend from the spacer cord for encircling the rings 12. An example of such an alternative embodiment may be appreciated from FIG. 9.

Hitches 22 may be loose hitch knots that permit the lift cord that the hitch 22 encircles to easily pass through the hitch 22 when the window covering is raised and lowered. However, if the lift cord is pulled in a horizontal direction away from the window covering material the hitch engages the lift cord and grips the lift cord to prevent the lift cord from separating from the spacer cord. Therefore, the length of the spacer cord and the spacing of the rings define the size of any loop that can be formed by the lift cord.

Typically, a small child would not have the dexterity necessary to separate the lift cord from the spacer cord for purposes of pulling the lift cord away from the window covering material to form a noose or loop that may be a strangulation threat to the child. However, it is conceivable that a small child could pull on only a lift cord either by accident or on purpose. Should that occur, the use of hitches 22 prevents separation of the lift cord 6 from the spacer cord 16 as the hitches tighten to engage the lift cord and prevent the lift cord from moving horizontally away from the spacer cord to form a loop capable of posing a strangulation hazard to a child. It should be appreciated that while the hitches 22 tighten upon horizontal movement of the lift cord away from the spacer cord, the hitches may not tighten about the lift cord as it moves vertically when the window covering is raised or lowered.

Figure 11:
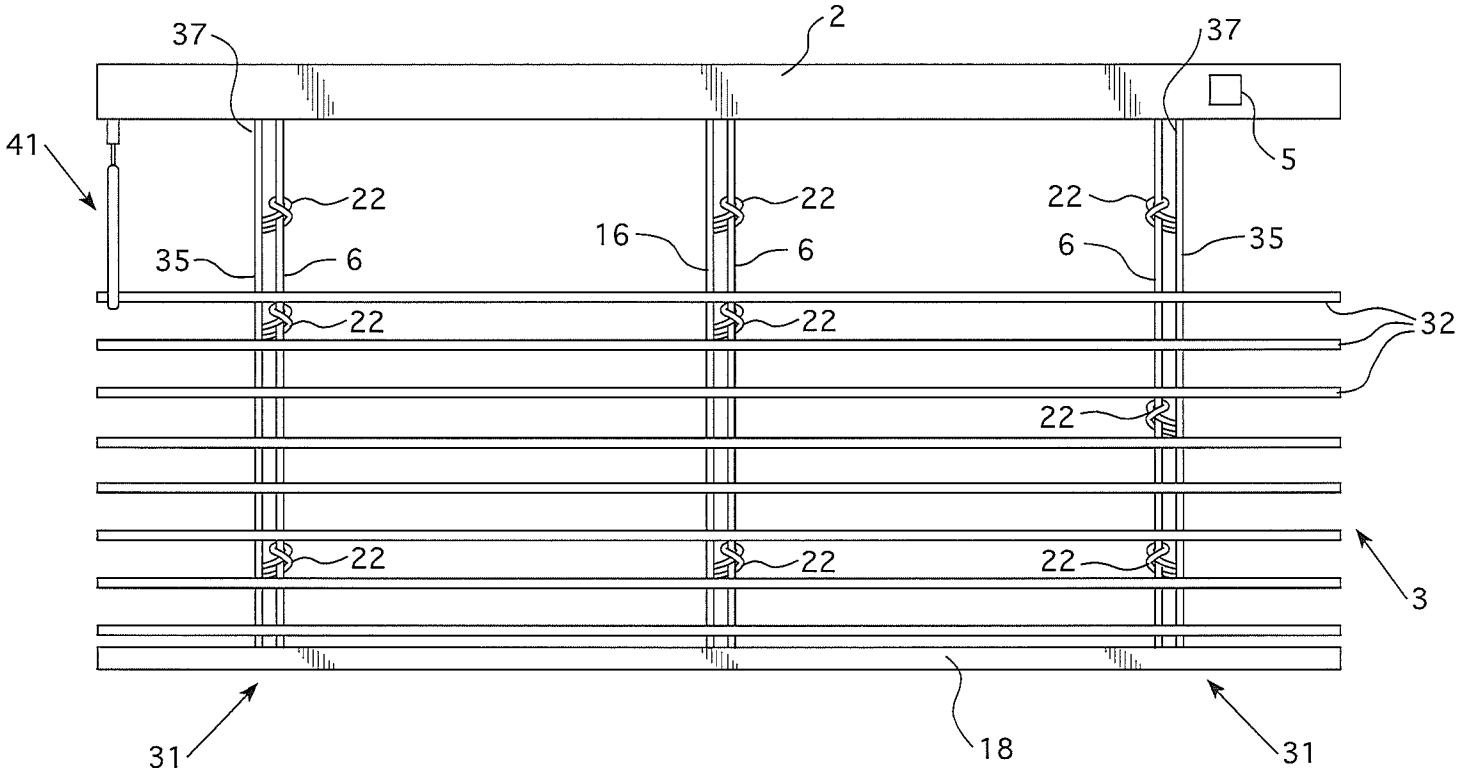
FIG. 11 is a front view of an embodiment of the window covering configured as a blind having slats supported on ladders.

In yet other embodiments of the window covering, the window covering may be configured as a blind such as a mini blind or Venetian blind of the type shown in FIG. 11. Such blinds usually have two ladders 31 positioned on opposite sides of the window covering material 3. The ladders 31 are used to support slats 32 of such blinds. In some blinds, additional ladders may be positioned in the middle portion of the blind as well.

The lift cords 6 may extend from the headrail 2 of the blind to a bottommost slat of the slats. If a bottom rail is included in the blind, the lift cords may extend from the headrail 2 to the bottom rail 18, which is positioned adjacent to the bottommost slat and is below the bottommost slat.

Each ladder 31 includes two spaced apart rails 35. Each pair of rails includes a front rail and a rear rail that extends adjacent an end of the slats and support a plurality of vertically spaced apart rungs (not shown) that extend between the two rails and are parallel to rungs of the opposite ladder. The slats 32 rest on the rungs of the ladder 31. Referring to FIG. 11, the blind may include a spacer cord 16 that extends from the headrail 2 of the blind to the bottom rail 18 and passes through the slats 32. The spacer cord 16 may be positioned adjacent to a respective or corresponding lift cord 6 and have hitches 22 that encircle the lift cord to prevent the lift cord from forming dangerous loops if a child attempts to pull the lift cord away from the slats. Additionally, spacer cords 37 may be portions of one or both rails of each ladder instead of a separate cord element. Such spacer cords 37 may be a portion of one of the rails of the ladder and hitches 22 may extend from portions of one or both rails to a lift cord of the blind.

A tilt mechanism 41 may be attached to the headrail 2 of the blind. The tilt mechanism may be actuatable by rotation of a rod or another actuation mechanism. The tilt mechanism may be connected to the ladders 31 of the blind so that actuation of the tilt mechanism causes the ladders to move to tilt the slats. The slats 32 may be tilted from an open position to a closed position.

Testing was conducted on embodiments of the window covering 1 that were configured similarly to the embodiments shown in FIGS. 1-8. The testing compared a window covering similar to the embodiment of FIGS. 1-8, which utilized hitches 22, with a version of a Roman shade similar to the shade illustrated in U.S. Patent Application Publication No. 2011/0186242, which does not utilize hitches. Instead, that shade only utilized loops 21 extending from spacer cord 16 to a respective column of rings and a lift cord.

The testing was done to determine whether each shade could comply with the standards of Sections 4.4 and 4.5 as set forth in the Second Provisional ANSI/WCMA A100.1-2010 standard. The testing was done to determine if either shade could pass the test described in Appendix D of the Second Provisional ANSI/WCMA A100.1-2010 standard. For example, a force gauge arm subassembly was utilized on mounted window coverings to pull the lift cords of the window coverings horizontally away from the spacer cord and window covering material until a tension force of 5 pounds or a pulled distance of 25 inches was reached. Thereafter, a head probe was placed adjacent the opening formed by the pulled lift cord to attempt to insert the head probe between the lift cord and window covering material. If the head probe could not pass through the opening formed by the pulled cord, the window covering passed the test. If the head probe could pass through the opening formed by the horizontally pulled lift cord, then the window covering failed the test.

Figure 2:
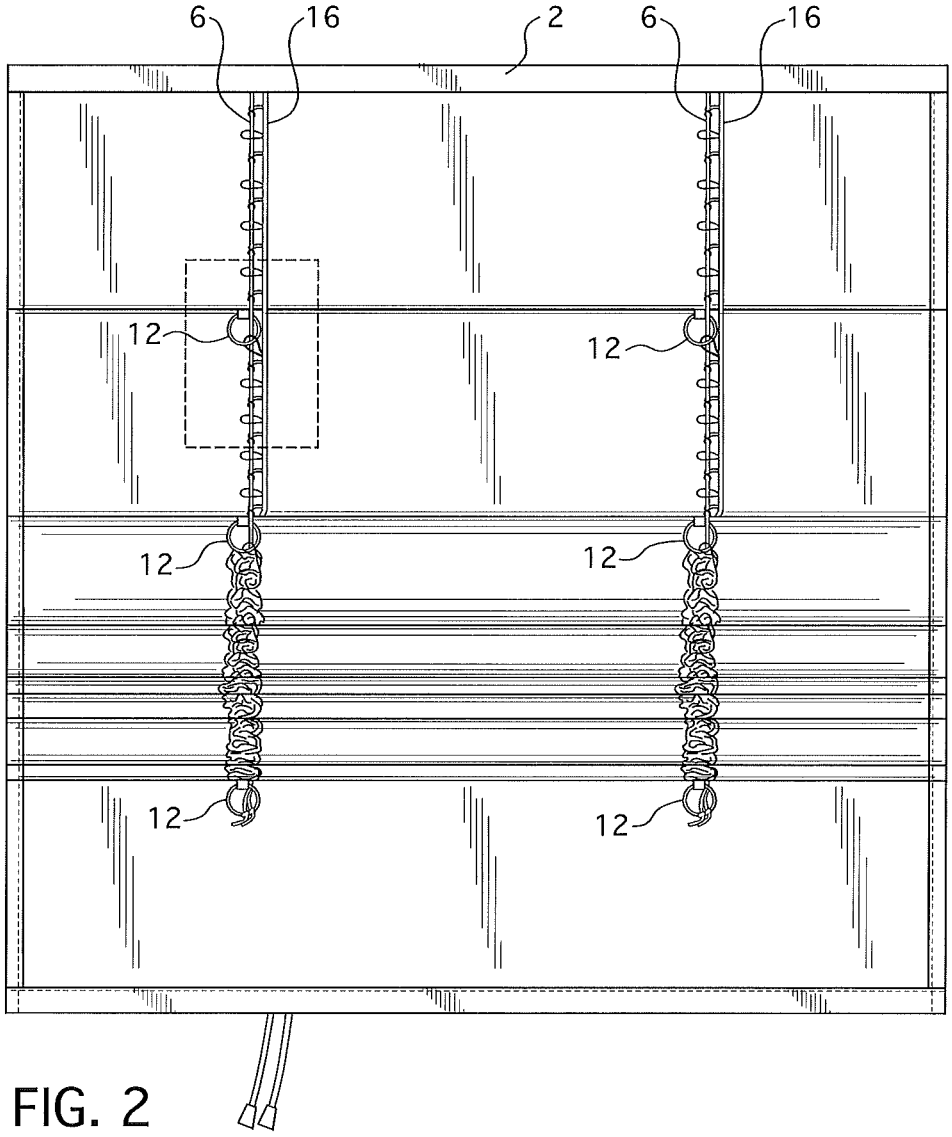
FIG. 2 is a rear view of the first present preferred embodiment of the window covering in a partially retracted, or partially raised, position.
Figure 3:
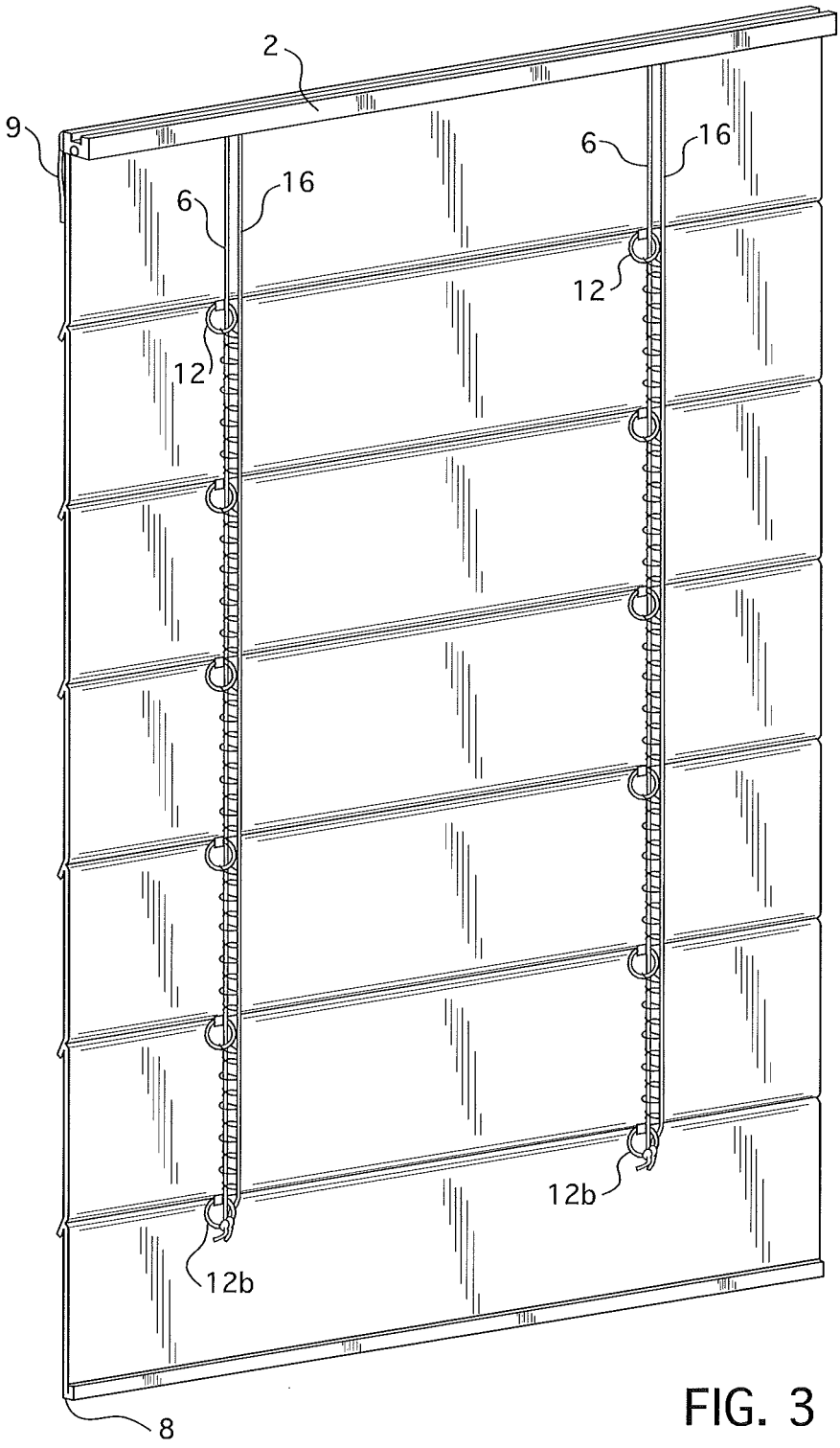
FIG. 3 is a rear perspective view of the first present preferred embodiment of the window covering in an extended, or lowered, position.
Figure 4:
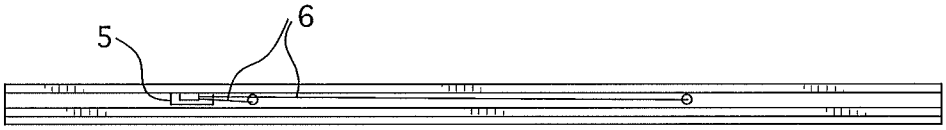
FIG. 4 is a top view of the first present preferred embodiment of the window covering.
Figure 5:
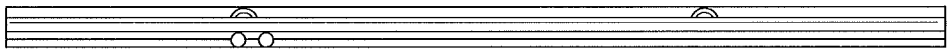
FIG. 5 is a bottom view of the first present preferred embodiment of the window covering.
Figure 6:
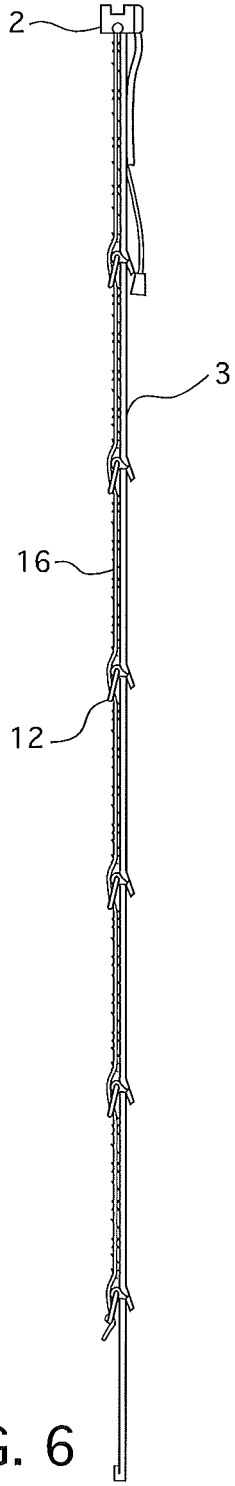
FIG. 6 is a left side view of the first present preferred embodiment of the window covering in an extended position, or lowered position.
Figure 7:
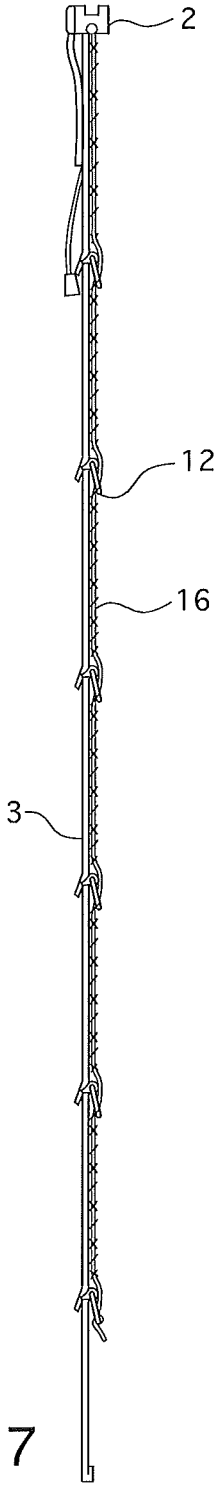
FIG. 7 is a right side view of the first present preferred embodiment of the window covering in an extended position, or lowered position.
Figure 8:
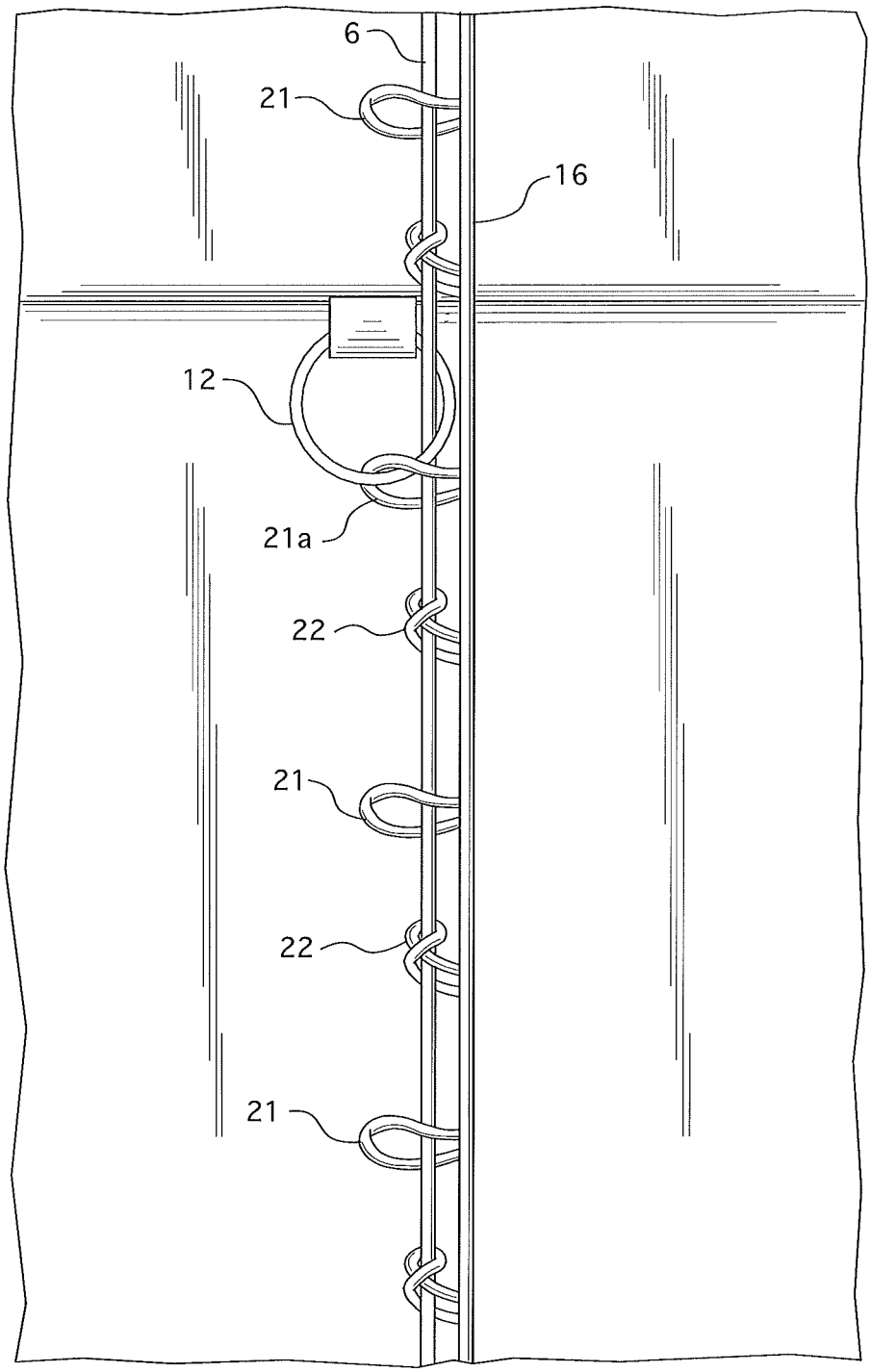
FIG. 8 is an enlarged fragmentary view of a portion of the first present preferred embodiment of the window covering encircled by the dotted line box shown in FIG. 2.

Testing showed that the design disclosed in FIG. 2 of U.S. Patent Application Publication No. 2011/0186242 failed to pass the test of Exhibit D of the Second Provisional ANSI/WCMA A100.1-2010 standard. However, the embodiment of my window covering 1, which utilizes hitches 22, passed this test. The hitches were able to prevent horizontal movement of the lift cords away from the spacer cords and window covering material sufficiently to prevent dangerous loop formations by gripping the lift cord that they encircled and frictionally engaging the lift cord to prevent separation of the lift cord from the spacer cord and window covering material.

It should be appreciated that various changes may be made to my window covering for purposes of meeting a particular design objective. For instance, some embodiments may be configured as a top down bottom up shade. Alternatively, embodiments of the window covering may be configured as a pleated shade or other type of shade or blind. Other embodiments may utilize more than two sets of lift cords, spacer cords and columns of rings. As another example, the window covering material could be any of a number of materials suitable for covering a window.

While certain present preferred embodiments of the window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a first rail;

window covering material attached to the first rail, the window covering material moveable from a retracted position to an extended position, the window covering material having a top portion adjacent the first rail and a bottom portion opposite the top portion;

a first lift cord extending from the first rail to the window covering material;

a second lift cord extending from the first rail to the window covering material;

at least one first spacer cord extending from the first rail to a position adjacent to the bottom portion of the window covering material;

a plurality of first hitches extending from the at least one first spacer cord, each of the first hitches encircling a portion of the first lift cord;

at least one second spacer cord extending from the first rail to a position adjacent to the bottom portion of the window covering material; and a plurality of second hitches that extend from the at least one second spacer cord, each of the second hitches encircling a portion of the second lift cord;

wherein each of the first hitches engages the first lift cord to grip and hold the first lift cord when the first lift cord moves a predetermined distance horizontally away from the at least one first spacer cord to prevent the first lift cord from further horizontal movement away from the at least one first spacer cord independent of the at least one second spacer cord; and wherein each of the second hitches engage the second lift cord to grip and hold the second lift cord when the second lift cord moves a predetermined distance horizontally away from the at least one second spacer cord to prevent the second lift cord from further horizontal movement independent of the at least one first spacer cord.

2. The window covering of claim 1 wherein the first spacer cord is also comprised of:

a plurality of rings attached to the window covering material, the rings comprising a first column of vertically spaced apart rings and a second column of vertically spaced apart rings, the first column of rings being parallel to the second column of rings;

third hitches, each of the third hitches extending from the at least one first spacer cord and encircling the rings of the first column of rings; and wherein the at least one second spacer cord is also comprised of fourth hitches, each of the fourth hitches extending from the at least one second spacer cord and encircling the rings of the second column of rings; and wherein the first lift cord passes through the rings of the first column of rings or passes adjacent to the rings of the first column of rings and the second lift cord passes through the rings of the second column of rings or passes adjacent to the rings of the second column of rings.

3. The window covering of claim 1 further comprising:

a plurality of rings attached to the window covering material, the rings comprising a first column of vertically spaced apart rings and a second column of vertically spaced apart rings, the first column of rings being parallel to the second column of rings; and wherein the at least one first spacer cord is also comprised of first loops, each of the first loops extending from the at least one first spacer cord and encircling the rings of the first column of rings; and wherein the at least one second spacer cord is also comprised of second loops, each of the second loops extending from the at least one second spacer cord and encircling the rings of the second column of rings.

4. The window covering of claim 3 wherein the first hitches are arranged such that each first loop is positioned on the at least one first spacer cord between first hitches and the second hitches are arranged such that each second loop is positioned on the at least one second spacer cord between second hitches.

5. The window covering of claim 1 wherein the at least on first spacer cord is a portion of a first ladder configured to support slats and the at least one second spacer cord is a portion of a second ladder configured to support slats and wherein the window covering material is comprised of slats supported on the first and second ladders.

6. The window covering of claim 5 further comprising a second rail attached to the first lift cord and the second lift cord and wherein the first ladder is comprised of a pair of spaced apart rails extending from the first rail to the second rail and the at least one first spacer cord is only comprised of a rail of the first ladder and wherein the second ladder is comprised of a pair of spaced apart rails extending from the first rail to the second rail and the at least one second spacer cord is only comprised of a rail of the second ladder.

7. The window covering of claim 5 further comprising a tilt mechanism attached to the first rail, the tilt mechanism actuatable to move the first and second ladders to tilt the slats.

8. A window covering comprising:

a first rail;

window covering material attached to the first rail, the window covering material moveable from a retracted position to an extended position, the window covering material having a top portion adjacent the first rail and a bottom portion opposite the top portion;

a first lift cord extending from the first rail to the window covering material;

a second lift cord extending from the first rail to the window covering material;

at least one first spacer cord extending from the first rail to a position adjacent to the bottom portion of the window covering material;

a plurality of first hitches extending from the at least one first spacer cord, each of the first hitches encircling a portion of the first lift cord;

at least one second spacer cord extending from the first rail to a position adjacent to the bottom portion of the window covering material;

a plurality of second hitches that extend from the at least one second spacer cord, each of the second hitches encircling a portion of the second lift cord; and wherein the first rail is a headrail;

wherein each of the first hitches engages the first lift cord to grip and hold the first lift cord when the first lift cord moves a predetermined distance horizontally away from the at least one first spacer cord to prevent the first lift cord from further horizontal movement away from the at least one first spacer cord independent of the at least one second spacer cord; and wherein each of the second hitches engage the second lift cord to grip and hold the second lift cord when the second lift cord moves a predetermined distance horizontally away from the at least one second spacer cord to prevent the second lift cord from further horizontal movement independent of the at least one first spacer cord.

9. The window covering of claim 8 further comprising a bottom rail attached to at least one of the first lift cord, the second lift cord, and the bottom portion of the window covering material.

10. The window covering of claim 9 wherein the first rail is a headrail and the window covering material is comprised of fabric material, pleated material, cellular material, interconnected fabric segments, woven wood, woven grass, or bamboo material.

11. The window covering of claim 9 wherein the bottom rail is attached to a terminal end of the first lift cord and a terminal end of the second lift cord.

12. The window covering of claim 8 further comprising a lift cord control mechanism attached to the first rail.

13. The window covering of claim 12 wherein the lift cord control mechanism is attached to the first lift cord and the second lift cord.

14. The window covering of claim 13 wherein the lift cord control mechanism comprises a cord lock through which the first lift cord and the second lift cord pass.

15. The window covering of claim 8 wherein the window covering material is pleated material.

16. The window covering of claim 8 wherein the window covering material is comprised of slats supported on ladders that extend from the first rail.

17. A window covering comprising:

a first rail;

window covering material attached to the first rail, the window covering material moveable from a retracted position to an extended position, the window covering material having a top portion adjacent the first rail and a bottom portion opposite the top portion;

a first lift cord extending from the first rail to the window covering material;

a second lift cord extending from the first rail to the window covering material;

at least one first spacer cord extending from the first rail to a position adjacent to the bottom portion of the window covering material;

a plurality of first hitches extending from the at least one first spacer cord, each of the first hitches encircling a portion of the first lift cord;

at least one second spacer cord extending from the first rail to a position adjacent to the bottom portion of the window covering material;

a plurality of second hitches that extend from the at least one second spacer cord, each of the second hitches encircling a portion of the second lift cord; and wherein the first rail is a headrail;

wherein each of the first hitches engages the first lift cord to grip and hold the first lift cord when the first lift cord moves a predetermined distance horizontally away from the at least one first spacer cord to prevent the first lift cord from further horizontal movement away from the at least one first spacer cord and the window covering material independent of the at least one second spacer cord; and wherein each of the second hitches engage the second lift cord to grip and hold the second lift cord when the second lift cord moves a predetermined distance horizontally away from the at least one second spacer cord and the window covering material to prevent the second lift cord from further horizontal movement independent of the at least one first spacer cord.

18. A window covering comprising:

a first rail;

window covering material attached to the first rail, the window covering material moveable from a retracted position to an extended position, the window covering material having a top portion adjacent the first rail and a bottom portion opposite the top portion;

a first lift cord extending from the first rail to the window covering material;

a second lift cord extending from the first rail to the window covering material;

at least one first spacer cord extending from the first rail to a position adjacent to the bottom portion of the window covering material;

a plurality of first hitches extending from the at least one first spacer cord, each of the first hitches encircling a portion of the first lift cord;

at least one second spacer cord extending from the first rail to a position adjacent to the bottom portion of the window covering material;

a plurality of second hitches that extend from the at least one second spacer cord, each of the second hitches encircling a portion of the second lift cord; and a plurality of rings attached to the window covering material, the rings comprising a first column of vertically spaced apart rings and a second column of vertically spaced apart rings, the first column of rings being parallel to the second column of rings; and wherein the first rail is a headrail and wherein the first lift cord passes through the rings of the first column of rings or passes adjacent to the rings of the first column of rings and the second lift cord passes through the rings of the second column of rings or passes adjacent to the rings of the second column of rings; and one of:

(a) the at least one first spacer cord is also comprised of third hitches, each of the third hitches extending from the first spacer cord and encircling the rings of the first column of rings; and wherein the at least one second spacer cord is also comprised of fourth hitches, each of the fourth hitches extending from the at least one second spacer cord and encircling the rings of the second column of rings and (b) the at least one first spacer cord is also comprised of first loops, each of the first loops extending from the at least one first spacer cord and encircling the rings of the first column of rings; and wherein the at least one second spacer cord is also comprised of second loops, each of the second loops extending from the at least one second spacer cord and encircling the rings of the second column of rings;

wherein each of the first hitches engages the first lift cord to grip and hold the first lift cord when the first lift cord moves a predetermined distance horizontally away from the at least one first spacer cord to prevent the first lift cord from further horizontal movement away from the at least one first spacer cord and the window covering material independent of the at least one second spacer cord; and each of the second hitches engage the second lift cord to grip and hold the second lift cord when the second lift cord moves a predetermined distance horizontally away from the at least one second spacer cord and the window covering material to prevent the at least one second lift cord from further horizontal movement independent of the at least one first spacer cord.

19. A blind comprising:

a first rail;

a first ladder extending from the first rail, the first ladder comprising a pair of spaced apart rails that extend from the first rail and a plurality of spaced apart rungs that extend between the pair of rails;

a second ladder extending from the first rail, the second ladder comprising a pair of spaced apart rails that extend from the first rail and a plurality of spaced apart rungs that extend between the pair of rails;

slats supported on the rungs of the first and second ladders;

a first lift cord extending from the first rail to a position adjacent a bottommost slat of the slats; and at least one first spacer cord extending from the first rail to a position adjacent to the bottommost slat, the at least one first spacer cord having a plurality of first hitches that extend from the at least one first spacer cord, each of the first hitches encircling a portion of the first lift cord;

wherein each of the first hitches engages the first lift cord to grip and hold the first lift cord when the first lift cord moves a predetermined distance horizontally away from the at least one first spacer cord to prevent the first lift cord from further horizontal movement away from the at least one first spacer cord independent of the at least one second spacer cord.

20. The blind of claim 19 further comprising:

a second lift cord extending from the first rail to a position adjacent a bottommost slat of the slats; and at least one second spacer cord extending from the first rail to a position adjacent to the bottommost slat, the at least one second spacer cord having a plurality of first hitches that extend from the at least one first spacer cord, each of the first hitches encircling a portion of the second lift cord;

wherein each of the second hitches engages the second lift cord to grip and hold the second lift cord when the second lift cord moves a predetermined distance horizontally away from the at least one second spacer cord to prevent the second lift cord from further horizontal movement away from the at least one second spacer cord independent of the at least one first spacer cord.

* * * * *